US005398853A

United States Patent [19]

Latham

[11] Patent Number: 5,398,853

[45] Date of Patent: Mar. 21, 1995

[54] DISCHARGE NOZZLE

[76] Inventor: Peter A. Latham, 295 Beacon St., Boston, Mass. 02116

[21] Appl. No.: 186,561

[22] Filed: Jan. 26, 1994

[51] Int. Cl.[6] ..... B65D 5/72

[52] U.S. Cl. ..... 222/491; 222/107; 137/846

[58] Field of Search ..... 222/107, 490, 494, 491; 239/533.13; 137/846, 849

[56] References Cited

U.S. PATENT DOCUMENTS

| | | | |
|---|---|---|---|
| 1,770,630 | 7/1930 | Smith | 222/490 |
| 2,303,992 | 12/1942 | Frazer et al. . | |
| 2,507,248 | 5/1950 | Swart . | |
| 2,550,132 | 4/1951 | Woods | 222/490 |
| 2,670,884 | 3/1954 | Swartz | 222/490 |
| 2,792,149 | 5/1957 | Lutz | 222/494 X |
| 3,118,468 | 1/1964 | Bochan | 137/846 |
| 3,129,894 | 4/1964 | Schermerhorn . | |
| 3,825,157 | 7/1974 | Herzig . | |
| 4,109,836 | 8/1978 | Falaroe . | |
| 4,513,891 | 4/1985 | Hain et al. . | |
| 4,524,805 | 6/1985 | Hoffman | 137/846 |
| 4,526,296 | 7/1985 | Berger et al. . | |
| 4,869,431 | 9/1989 | Jubert et al. | 239/533.13 |
| 4,869,431 | 9/1989 | Jubert et al. . | |

FOREIGN PATENT DOCUMENTS 417793 10/1934 United Kingdom .

*Primary Examiner*—Gregory L. Huson
*Attorney, Agent, or Firm*—Richard C. Litman

[57] ABSTRACT

The present invention is a discharge nozzle for flexible dispensing tubes containing paste-like or semi-liquid substances. It solves the problem of having to contact the discharge opening of the dispensing tube against a secondary surface to cut off the flow of substance. This is advantageous for eliminating the transfer of germs between the discharge opening of the dispensing tube and the secondary surface. Additionally, it solves the problem of eliminating unwanted accumulation of substance at the nozzle discharge, even when the dispensing tube is used in a repetitive manner, over a long period of time. The nozzle is small in size, has a symmetrical interior surface, and has a discharge portion formed at least partially from a material possessing a low coefficient of friction. This discharge portion has an elongated slit and is attached to a tubular neck. The elongated slit may be configured in the shape of an "I" to form two displaceable tongues.

19 Claims, 3 Drawing Sheets

FIG. 1
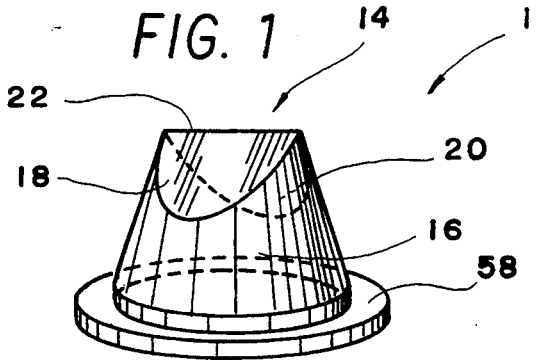
FIG. 2
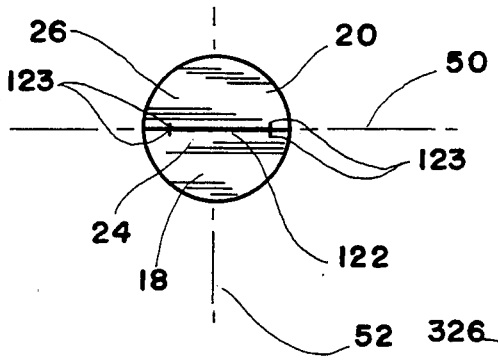
FIG. 3
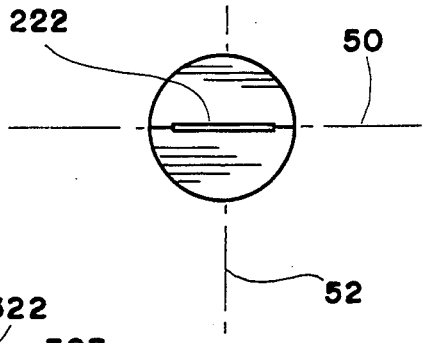
FIG. 4
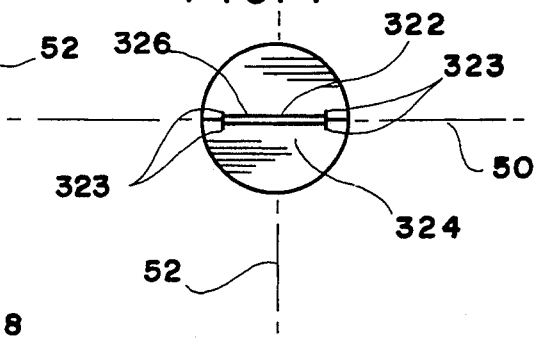
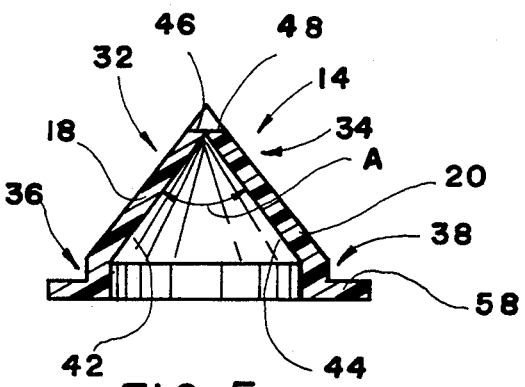
FIG. 5
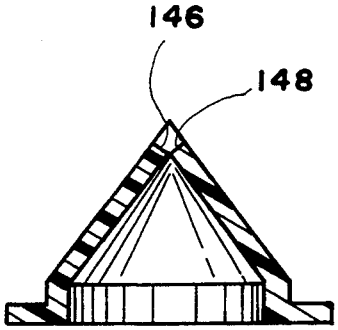
FIG. 6

DISCHARGE NOZZLE

BACKGROUND OF THE INVENTION

1. Field of the Invention

The present invention relates to a nozzle for dispensing paste-like or semi-liquid substances from a flexible dispensing tube or container. More particularly, this invention relates to a nozzle wherein the discharge of the paste-like or semi-liquid substance from the nozzle is selectively terminated without the nozzle contacting the surface upon which the substance has been discharged, and without undesired accumulation of the substance at the discharge portion of the nozzle.

2. Description of the Prior Art

The discharge of fluids from dispensing tubes, containers, or similar devices, is substantially controlled by the configuration of the discharge opening or spout through which the discharge fluid flows. To obtain a desired characteristic of fluid discharge, a nozzle is often added to the discharge opening or spout to alter the characteristics of the fluid flow. These nozzles control such features as the rate and shape of fluid flow, and the termination or cut off of dispensing.

Patents relating to nozzles for controlling the rate and shape of fluid flow are U.S. Pat. No. 2,303,922 issued to Frazer on Dec. 1, 1942, U.S. Pat. No. 3,129,894 issued to Schermerhorn on Apr. 21, 1964, and U.S. Pat. No. 4,869,432 issued to Jubert on Sep. 26, 1989. The Frazer patent discloses an injector nozzle having a converging portion ending at an outlet. When the pressure of the fluid inside the nozzle increases, the walls of the converging portion push outward, thus increasing the size of the outlet. As the size of the opening of the outlet is directly related to the pressure of the fluid inside the nozzle, the velocity of the fluid issuing from the outlet is maintained at a substantially constant rate.

The Schermerhorn patent shows a nozzle permitting variably restrictive flow from a faucet spout. This nozzle includes a tubular inlet portion and a progressively restricted tubular outlet portion terminating in a slit. A guard, movable about the outside surface of the nozzle, may be positioned to narrow the portion of the nozzle through which the fluid is discharged. The various positions of this guard determine the flow rate.

The nozzle described in the Jubert patent is for placement in a hydraulic or pneumatic system. The outlet dimensions of this nozzle deviate according to the pressure differential between the nozzle inlet and the nozzle outlet. One embodiment of this invention incorporates a generally flat surface positioned across the diameter of a pipe. Three slits in this generally flat surface form two displaceable tongues which allow fluid to exit the pipe. When observed from a top plan view, the slits in this generally flat surface form an "H" shape wherein the two tongues are opposite one another.

Patents pertaining to the termination or cutting-off of dispensing from a tube or similar device are U.S. Pat. No. 2,507,248 issued to Swart on May 9, 1950, U.S. Pat. No. 3,825,157 issued to Herzig on Jul. 23, 1974, U.S. Pat. No. 4,109,836 issued to Falarde on Aug. 29, 1978, and U.S. Pat. No. 4,513,891 issued to Hain on Apr. 30, 1985.

The Swart patent discloses a nozzle for a flexible tube having a U-shaped slit formed at one of the sides of the nozzle tip. This slit forms a tongue having one end displaceable from the surface of the nozzle when pressures of the fluid inside the nozzle increase upon squeezing the walls of the tube. When the squeezing of these walls is terminated, the fluid inside the nozzle no longer exerts pressure against the tongue. Therefore, displacement of the tongue from the surface of the nozzle is terminated.

The manner in which the flow of fluid is cut off form the nozzles disclosed in the Herzig the Falarde patents is similar to the manner described in the Swart patent. Although the Herzig and Falarde patents do not use tongues as disclosed in Swart, they do incorporate slits which open and close in relation to the strength of the fluid pressure against the nozzle tip. The nozzles described in both of these patents include tapered necks terminating in the slits.

The Hain patent discloses a spray dispensing container for use in the administration of nasal sprays. The spray bottle includes a spray nozzle fitted into a closure cap. The closure cap, which has a central opening for receiving the spray nozzle, has walls removably attached to the neck of the bottle. A series of air inlets arranged about the closure cap permit the bottle to return to its original shape after squeezing.

None of the above inventions and patents, taken either singly or in combination, is seen to describe the instant invention as claimed.

SUMMARY OF THE INVENTION

The present invention is a discharge nozzle for flexible dispensing tubes and pumps containing paste-like or semi-liquid substances. It solves the problem of having to contact the discharge opening of the dispensing tube against a secondary surface to cut off the flow of substance. This is advantageous for eliminating the transfer of germs between the dispensing tube and the secondary surface. Additionally, it solves the problem of eliminating unwanted accumulation of substance at the nozzle discharge, even when the dispensing tube is used in a repetitive manner, over a long period of time. The nozzle is small in size, has a symmetrical interior surface, and has a discharge portion having an interior surface fabricated from a material possessing a low coefficient of friction. This discharge portion has an elongated slit and is attached to a tubular neck. The elongated slit may be configured in the shape of an "I" to form two displaceable tongues.

The paste-like or semi-liquid substance passes through the nozzle when the walls of the tube are squeezed. Pressures resulting from this squeezing force the substance against the portions of the nozzle surrounding the slit. When the squeezing of the walls of the tube is terminated, the tube body returns to its original shape. This causes the substance surrounding the slit to be drawn back towards the interior of the tube, away from the discharge portion. The discharge is effectively and automatically cut off from the nozzle, and accumulation of substance around the discharge portion is prevented. Therefore, clogging of the nozzle is eliminated.

Accordingly, it is a principal object of the invention to provide a novel dispensing nozzle for automatically terminating or cutting-off the discharge of paste-like or semi-liquid substances from a flexible dispensing tube, without having to contact the flexible dispensing tube against a secondary surface.

It is another object of the invention to provide a novel dispensing nozzle which eliminates build-up on or clogging within the flexible dispensing tube by facilitating the post-dispensing return of the non-dispensed substance toward an area of the tube remote from the outlet.

It is a further object of the invention to provide a novel dispensing nozzle utilizing a minimal amount of material possessing a low coefficient of friction to minimize the cost of the nozzle.

Still another object of the invention is to provide a novel dispensing nozzle which may be readily attached to or removed from a flexible dispensing tube.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 1 is a perspective view of the dispensing nozzle of this invention.

FIG. 2 is a top, plan view of the discharge portion of the nozzle of this invention having an "I" shaped slit.

FIG. 3 is a top, plan view of the discharge portion of the nozzle of this invention having an elongated, open slit.

FIG. 4 is a top, plan view of the discharge portion of the nozzle of this invention having an "I" shaped slit with an elongated, open center.

FIG. 5 is a side, elevational view in cross section of the nozzle of this invention showing the configuration of the dispensing slit.

FIG. 6 is a side, elevational view in cross section of an alternate embodiment of the configuration of the dispensing slit.

Similar reference characters denote corresponding features consistently throughout the attached drawings.

DETAILED DESCRIPTION OF THE PREFERRED EMBODIMENTS

Figure 7:
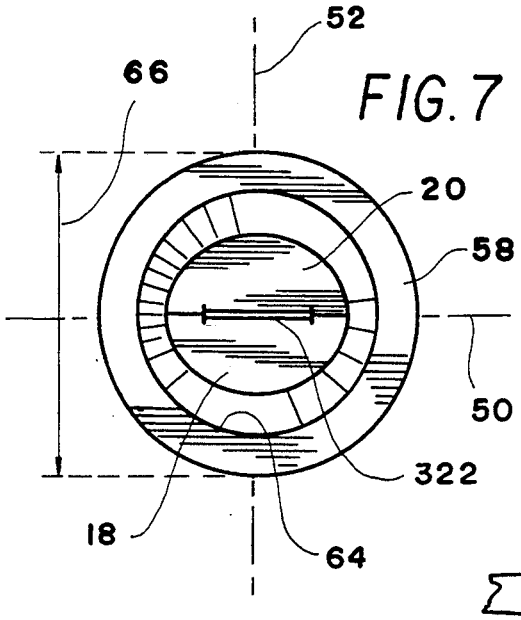
FIG. 7 is a bottom view of the nozzle of this invention.

The present invention is a discharge nozzle 1 for a flexible dispensing tube 10 containing paste-like or semi-liquid substance 12 such as toothpaste, ketchup, or adhesives. It allows flow of substance 12 from the nozzle 1 to be cut off without having to contact the nozzle 1 against the surface upon which the substance is dispensed. This is advantageous, for example, when dispensing toothpaste onto a toothbrush. As the flow of toothpaste is effectively terminated without having to rub the nozzle 1 against the toothbrush, the transfer of germs between the toothbrush and the nozzle 1 is minimized. Another advantage of this invention is the elimination of undesired accumulation of substances 12 at the nozzle discharge 14, even after multiple uses of the dispensing tube 10.

As seen in FIG. 1, the discharge nozzle 1 includes a cylindrical throat 16 attached to first and second walls, 18 and 20 respectively. These walls, 18 and 20, converge to form an elongated slit 22. The interiors, 42 and 44, of these walls, 18 and 20, are fabricated from a material having a low coefficient of friction of approximately 0.2. As most, if not all, of these low coefficient of friction materials are highly expensive, one advantage of the present invention is that it minimizes the amount of this material utilized in the nozzle 1. Apart from the interiors, 42 and 44, no other portion of the nozzle needs to include the expensive low coefficient of friction material.

The first and second walls, 18 and 20, may be entirely fabricated from this low coefficient of friction material. However, depending upon manufacturing and material costs, other means could be used for assuring that the interiors, 42 and 44, have a low coefficient of friction. For example, such means as a coating or lining could be utilized to form the interior of the nozzle, thus providing the interiors, 42 and 44, with the desired coefficient of friction.

It has been found that polytetrafluoroethylene is highly effective as a material for the interior surfaces, 42 and 44. However, other polymeric fluorocarbons have been found operative. These polymeric fluorocarbons include fluorinated ethylene propylene, perfluoroalkoxy resin, ethylene-chlorotrifluoroethylene copolymer, ethylene-tetrafluoroethylene copolymer, and polychlorotrifluoroethylene. Other low coefficient of friction materials that may be used include polypropylene, polyethylene, and acetal resins, such as an acetal homopolymer.

The configuration of the slit 22 substantially controls the characteristics of discharge from the nozzle 1. Therefore, the shape of the slit 22 is directly related to the flow rate and flow shape of each substance 12 that is discharged. FIGS. 2, 3 and 4 are top views showing the junction of the first and second walls, 18 and 20. These figures show three alternative embodiments of the elongated slit 22. FIG. 2 shows an "I" shaped slit 122 formed by attaching four additional slits 123 to the elongated slit. Two of these additional slits 123 extend into the first wall 18, and the other two extend into the second wall 22. The result is an "I" shaped configuration having two tongues, 24 and 26, which open to allow substance 12 to exit the nozzle 1 or close to cut off the flow and prevent substance 12 from exiting. That the slit 122 is "closed" means that in order for the substance 12 to flow through the slit 122, the substance 12 must exert pressure on the tongues, 24 and 26, to break the contact between them. To be most effective, the additional slits 323 are each angled to conform with the interior edge angles formed by the shape of surfaces, 42 and 44. These angles are each within approximately 20 degrees of axis 52.

On the other hand, an "open" slit includes a gap for substance 12 to pass without any forced widening of the slit. These type of slits are depicted in FIGS. 3 and 4. FIG. 3 shows an elongated rectangular slit 222 while FIG. 4 shows an "I" shaped slit 322 having an "open" elongated portion. As with the slit 122 in FIG. 2, the "I" shape of the slit 322 of FIG. 4 is formed from four additional slits 323 extending from the elongated slit. This configuration creates two deformable tongues 324 and 326 which can increase the width of slit 322. To be most effective, the additional slits 323 are each angled to conform with the interior edge angles formed by the shape of surfaces, 42 and 44. These angles are each within approximately 20 degrees of axis 52. The optimal distance between walls, 18 and 20, forming slit 222 of FIG. 3, is from 2 thousandths of an inch to 2 hundredths of an inch, while the optimal distance between walls, 18 and 20, forming slit 322 is between 2 thousandths of an inch and 1 tenth of an inch.

As stated previously, the slits shown in FIGS. 2, 3 and 4 are formed at the junction of the top edge of the first wall 32 and the top edge of the second wall 34. The bottom edges, 36 and 38, of these walls, 18 and 20, are attached to the throat 16. Interior surfaces, 42 and 44 of the walls, 18 and 20, converge to form an angle A, shown in FIGS. 5 and 6. The degree of this angle A is important to prevent accumulation of substance 12 on the interiors, 42 and 44, of the walls, 18 and 20, and the throat 16.

If the angle A is too small, there is a great possibility that clogging will occur. This is because a substantial percentage of fluid 12 flowing through the narrow passageway between the walls, 18 and 20, contacts the inner surfaces, 42 and 44. The friction resulting from the contact of the substance 12 against the interior, 42 and 44 creates an accumulation of substance upon the walls, 18 and 20, resulting in clogging.

As the angle A between the first and second walls, 18 and 20, is increased, the percentage of substance 12 in contact with the interior surfaces, 42 and 44, decreases in relation to the amount of substance 12 in the nozzle 1. The substance 12, in the nozzle 1, not in contact with the interior surfaces, 42 and 44, flows more freely than the substance 12 contacting the walls, 18 and 20. Therefore, this substance exits the nozzle 1 without clogging.

When an amount of substance 12 is discharged from the flexible tube 10, the walls of the tube are squeezed to create pressures within the tube 1 which force the substance out the slit 22. Upon termination of this squeezing, the walls of the tube return to their non-deformed position creating a suction effect at the slit 22. This suction effect draws the substance 12 that is immediately surrounding the slit 22 toward the nozzle interior. This substance 12 slides on the interior, 42 and 44, of the nozzle walls, 18 and 20, to a location away from the slit 22 thus preventing accumulation and clogging of substance. If the angle A of the walls, 18 and 20, is too great, the forces resulting from the suction effect will be in a substantially different direction from the angle of the interiors, 42 and 44, of the walls, 18 and 20. Therefore, the substance 12 will not freely slide on this surface, 40 and 42, and will not be completely returned to a location away from the slit 22. The result is a build-up of substance 12 that may lead to clogging.

The optimal angle A for the discharge of paste-like or semi-liquid substance 12 from the nozzle 1 is dependent upon adherence properties of the material being discharged. When angle A is less than 180 degrees, the nozzle 1 has proved effective. However, more satisfactory results are achieved when this angle A is in the range of 10 degrees to 120 degrees, and optimal results occur when angle A is an acute angle, preferably between 20 and 90 degrees.

Also beneficial in eliminating build-up of substance is the configuration of the portion of the top edges, 32 and 34, forming the elongated slit. As the thickness of these top edges, 32 and 34, is increased, there is a greater likelihood that substance 12 adheres to the edges, 32 and 34, and is not removed by the post discharge suction effect. Therefore, it is important that these edges, 32 and 34, form sharp, narrow knife edges which diminish the surface area for substance to adhere.

FIGS. 5 and 6 show two different knife edge configurations of the portion of the top edges, 32 and 34, forming the elongated slit 22. The knife edges shown in FIG. 5 are referenced by numerals 46 and 48, while those of FIG. 6 are referenced by numerals 146 and 148. The configuration of FIG. 5 is achieved when the walls, 18 and 20, of the nozzle 1 are injection molded or sliced after thermoforming. The configuration of FIG. 6 most commonly arises when the walls, 18 and 20, of the nozzle 1 are die cut.

FIG. 7 is a bottom view of the nozzle 1. As can be seen from this figure, the interior surface of the nozzle 1 is symmetrical about axes 50 and 52. This symmetrical interior along with the slit described in FIGS. 2, 3, and 4, creates a discharged from the nozzle 1 that is straight, even and ribbon-like. The symmetry of the nozzle 1 also maintains equal draw back of substance 12 after discharge. If this symmetry were not present, there would be uneven drawing back of substance that could result in an accumulation of substance on one side of the nozzle 1.

In addition to the symmetry of this nozzle, the interior surface of the nozzle 1 could be configured to be completely rounded, without any corners or sharp angles to which substance may adhere and accumulate. As there is less concern that substance will accumulate on a smooth, rounded portion, as opposed to a corner or sharp angle, there is a more efficient flow during both the discharge of substance from the nozzle 1 and return of substance to the nozzle interior.

Figure 8:
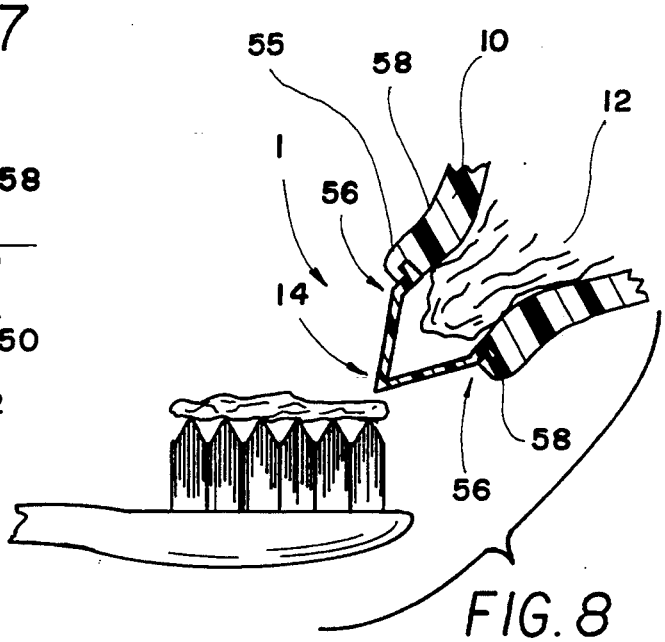
FIG. 8 is a partial, side, elevational view showing a first configuration of the nozzle of this invention where the nozzle attaches to the interior of the tube outlet.
Figure 9:
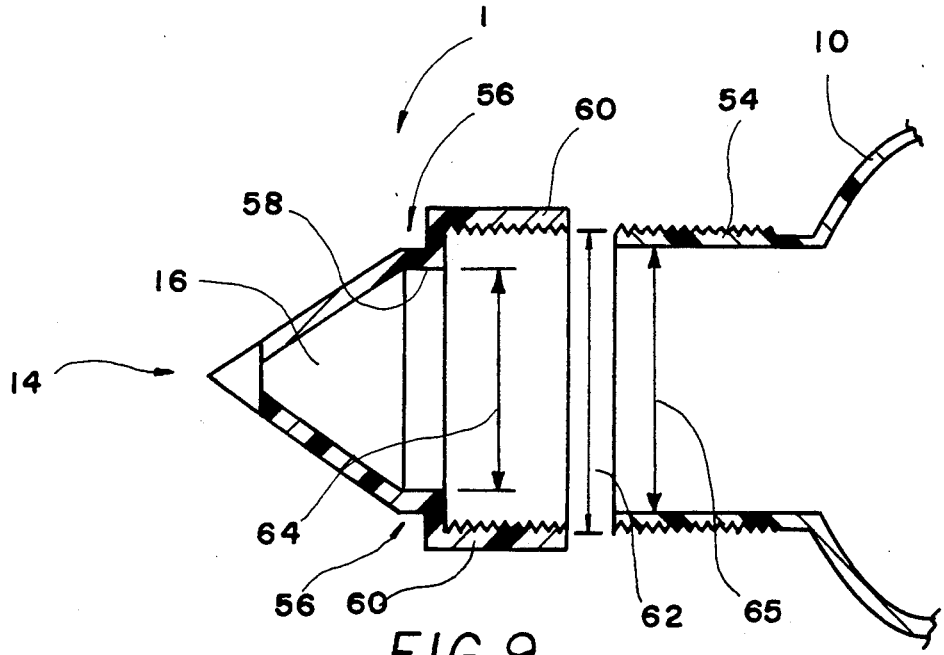
FIG. 9 is an exploded, side, view showing a second configuration of the nozzle of this invention where the nozzle and dispensing tube have a threaded relationship.
Figure 10:
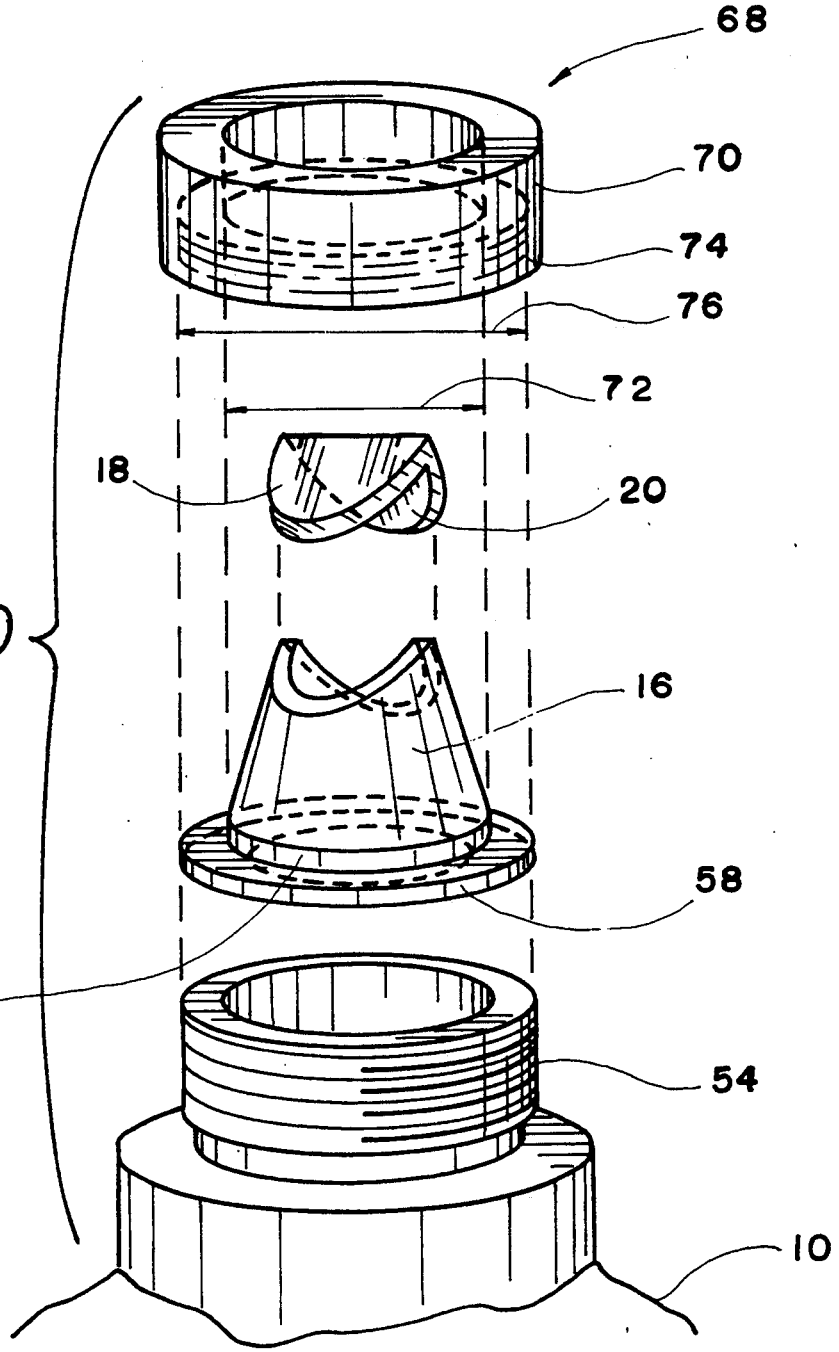
FIG. 10 is a partial, exploded, perspective view of the nozzle of this invention where a collar maintains the nozzle on the outlet of a dispensing tube.

The attachment of the nozzle 1 to the discharge spout 54 is depicted in FIGS. 8, 9, and 10, each of which represent an alternative method of attachment. FIG. 8 shows a configuration of the nozzle 1 where the bottom portion 56 of the throat 16 includes a rim 58. This rim fits inside a circular recessed portion in the inner surface of the discharge spout 54. The nozzle is then secured into place by the flange 55, which may be folded to its securing position using heat or other suitable means.

FIG. 9 shows a configuration of the nozzle 1 where the bottom portion 56 of the throat 16 includes a cylindrical extension 60 which fits over the discharge spout 54 of the dispensing tube 10. FIG. 9 shows this engagement as a threaded connection, however, the inner diameter 62 of the cylindrical extension 60 could be of a size to frictionally correspond to the discharge spout 54. Also shown in FIG. 9 is the size relationship of the inner diameter 64 of the rim 58 to the inner diameter 65 of the discharge spout 54. FIG. 9 shows the inner diameter 64 to be less than the inner diameter 65, however, this diameter may also be equal to the inner diameter 65. The importance of this size relationship is evidenced during the post discharge suction of substance 12 into the tube 10. If the inner diameter 64 of the rim 58 is greater than the inner diameter 65 of the discharge spout 54, return of the substance 12 from post discharge suction forces, would be blocked by the portion of the discharge spout 54 extending inward from the rim 58. This blockage would lead to eventual clogging of the nozzle 1.

FIG. 10 shows a cylindrical collar 68 having an upper portion 70 with an inner diameter 72. The collar 68 fits over the neck 16 of the nozzle 1 so the upper portion 70 of the collar 68 contacts the rim 58. The lower portion 74 of the collar 70 has an inner diameter 76 of a size which allows the lower portion 74 to telescope onto the discharge spout 54. FIG. 10 shows a threaded engagement between the lower portion 74 of the collar 70 to the discharge spout 54, however, this engagement could also be accomplished using a friction fit with a slight undercut.

Also shown in FIG. 10 is an exploded view of the first and second walls, 18 and 20. These walls, 18 and 20, can be manufactured separately from the rest of the nozzle 1 and then attached to the throat 16. They can be die cut, thermoformed, injection molded, or manufactured by any other suitable means. If die cut, the walls, 18 and 20, would originally have a circular appearance, as depicted in FIGS. 2, 3, and 4. The walls, 18 and 20, could then be angled with respect to each other to form the configuration shown in FIG. 10.

It is to be understood that the present invention is not limited to the sole embodiment described above, but encompasses any and all embodiments within the scope of the following claims.

I claim:

1. A discharge nozzle for use with a tube having a discharge spout, comprising:

a first wall having a top edge, a bottom edge, and an interior surface, said interior surface of said first wall being fabricated from a material having a low coefficient of friction;

a second wall having a top edge, a bottom edge, and an interior surface, said interior surface of said second wall being fabricated from a material having a low coefficient of friction, said top edge of said second wall being joined to said top edge of said first wall;

an elongated slit formed between a portion of the top edges of said first and second walls;

a first pair of additional slits, each of said first pair of additional slits extending from an opposite end of said elongated slit and into said first wall;

a second pair of additional slits, each of said second pair of additional slits extending from an opposite end of said elongated slit and into said second wall; and a throat having a top end, a bottom end, and a cylindrical interior surface, said top end of said throat being attached to said bottom edges of said first and second walls, whereby said interior surfaces of said first and second walls and said interior surface of said throat collectively form a nozzle interior, said nozzle interior being symmetrical about an axis parallel to said top edges of said first and second walls, said nozzle interior also being symmetrical about an axis perpendicular to said top edges of said first and second walls.

2. The discharge nozzle according to claim 1, wherein said first and second walls are joined to each other at an angle of less than 180 degrees.

3. The discharge nozzle according to claim 2, wherein said angle is between 10 and 120 degrees.

4. The discharge nozzle according to claim 2, wherein said angle is between 20 and 90 degrees.

5. The discharge nozzle according to claim 1, wherein said extension of each slit of said first and second pairs of additional slits is within 20 degrees of an axis perpendicular to said top edges of said first and second walls.

6. The discharge nozzle according to claim 1, wherein the portion of said first and second walls defining said elongated slit contact each other.

7. The discharge nozzle according to claim 1, wherein the portion of said first and second walls forming said elongated slit are separated from each other a distance ranging from 2 thousandths of an inch to 2 hundredths of an inch.

8. The discharge nozzle according to claim 1, wherein the portion of said first and second walls defining said elongated slit are separated from each other a distance ranging from 2 thousandths of an inch to 100 thousandths of an inch.

9. The discharge nozzle according to claim 1, wherein said first and second walls include knife edges.

10. The discharge nozzle according to claim 1, further comprising a rim encircling said bottom end of said throat.

11. The discharge nozzle according to claim 1, further comprising a cylindrical extension permanently affixed to said bottom end of said throat, said cylindrical extension having an inner diameter and dimensioned to receive the discharge spout of the tube.

12. The discharge nozzle according to claim 1, further comprising:

a rim encircling said bottom end of said throat, said rim having an inner diameter and an outer diameter;

a cylindrical collar for securing said discharge nozzle to the discharge spout of the tube, said cylindrical collar having a lower portion and an upper portion;

said lower portion of said cylindrical collar having an outer diameter greater than the outer diameter of said rim to receive said rim within said collar; and said upper portion of said cylindrical collar having an inner diameter smaller than said outer diameter of said rim to receive said discharge nozzle.

13. The discharge nozzle according to claim 1, wherein said bottom end of said throat has an inner diameter smaller than the inner diameter of the discharge spout of the tube.

14. The discharge nozzle according to claim 1, wherein said material is a fluorocarbon.

15. The discharge nozzle according to claim 14, wherein said material is a polymeric fluorocarbon.

16. The discharge nozzle according to claim 15, wherein said material is polytetrafluoroethylene.

17. The discharge nozzle according to claim 1, wherein said material is acetal resin.

18. The discharge nozzle according to claim 1, wherein said material is one of polypropylene and polyethylene.

19. A discharge nozzle for use with a tube having a discharge spout, comprising:

a first wall having a top edge, a bottom edge, and an interior surface, said interior surface of said first wall being fabricated from a material having a low coefficient of friction;

a second wall having a top edge, a bottom edge, and an interior surface, said interior surface of said second wall being fabricated from a material having a low coefficient of friction, said top edge of said second wall being joined to said top edge of said first wall whereby an acute angle is formed between said interior surfaces of said first and second walls;

an elongated slit formed between a portion of the top edges of said first and second walls;

a first pair of additional slits, each of said first pair of additional slits extending from an opposite end of said elongated slit and into said first wall;

a second pair of additional slits, each of said second pair of additional slits extending from an opposite end of said elongated slit and into said second wall; and a throat having a top end, a bottom end, and a cylindrical interior surface, said top end of said throat being attached to said bottom edges of said first and second walls, whereby said interior surfaces of said first and second walls and said interior surface of said throat collectively form a nozzle interior, said nozzle interior being symmetrical about an axis parallel to said top edges of said first and second walls, said nozzle interior also being symmetrical about an axis perpendicular to said top edges of said first and second walls.

* * * * *